United States Patent [19]

Wissmann et al.

[11] Patent Number: 4,610,229

[45] Date of Patent: Sep. 9, 1986

[54] CRANKSHAFT ASSEMBLY FOR AN ENGINE OF A PORTABLE TOOL

[75] Inventors: Michael Wissmann, Markgröningen; Hans Nickel, Cottenweiler; Reinhold Fink, Fellbach; Michael Leuchte, Stuttgart, all of Fed. Rep. of Germany

[73] Assignee: Andreas Stihl, Waiblingen, Fed. Rep. of Germany

[21] Appl. No.: 762,103

[22] Filed: Aug. 2, 1985

[30] Foreign Application Priority Data

Aug. 21, 1984 [DE] Fed. Rep. of Germany ..... 3430644

[51] Int. Cl.[4] ..... F02F 7/00

[52] U.S. Cl. ..... 123/195 R; 123/195 C; 92/169

[58] Field of Search ..... 92/169, 261; 123/195 C, 123/197 R, 195 R

[56] References Cited

U.S. PATENT DOCUMENTS 4,434,756 3/1984 Nilsson et al. ..... 123/195 R

*Primary Examiner*—Carroll B. Dority, Jr.

*Attorney, Agent, or Firm*—Walter Ottesen

[57] ABSTRACT

A portable tool such as a motor-driven chain saw is disclosed which includes a cylinder, a piston, a connecting rod and a crankshaft. The crankshaft is rotatably journalled in crankshaft bearings and a crankcase made of plastic is provided. The bearing shells of the crankshaft bearings are releasably connected only to the cylinder and independently of the plastic crankcase. The plastic crankcase is likewise attached to the cylinder in such a manner that a housing arrangement is provided which is free of transmitted forces and is fully independent of the crankshaft bearings.

16 Claims, 7 Drawing Figures

CRANKSHAFT ASSEMBLY FOR AN ENGINE OF A PORTABLE TOOL

FIELD OF THE INVENTION

The invention relates to a crankshaft assembly for an engine of a portable tool such as a chain saw or the like. The engine includes a cylinder, a piston, a connecting rod and a crankshaft. The crankshaft is rotatably journalled in a crankcase made of plastic.

BACKGROUND OF THE INVENTION

A portable tool is disclosed in published German patent application DE-OS No. 32 22 457 wherein a plastic crankcase containing the crankshaft bearings and their respective bearing shells is secured to the cylinder by means of threaded fasteners which pass through the crankcase from below. With this configuration, a substantial portion of the reaction forces occurring in the region of the crankshaft are directed to the crankcase during the operation of the motor and must be taken up by the crankcase. Accordingly, it is necessary that the crankcase be stable and be appropriately constructed since the operational reliability of the tool would otherwise be affected.

SUMMARY OF THE INVENTION

It is an object of the invention to provide a direct and tight connection between the bearing of the crankshaft and the cylinder as well as a lightweight plastic crankcase unaffected by the occurring crankshaft bearing forces.

The above object is realized with the crankshaft assembly of the invention. The crankshaft assembly is for an engine of a portable tool such as a chain saw or the like. The engine includes a cylinder, a piston arranged for movement in the cylinder, a crankshaft and a connecting rod interconnecting the piston and the crankshaft. The crankshaft assembly includes bearing means for rotatably journalling the crankshaft and for receiving the reaction forces transmitted to the latter during operation of the engine, bearing shell means for holding the bearing means therein, the bearing shell means being rigidly connected directly to the cylinder to thereby take up the forces and, a plastic crankcase enclosing the crankshaft and the bearing means, the crankcase being mounted on the cylinder separately from the bearing shell means so as to prevent transmitting the forces from the bearing shell means to the plastic crankcase.

The preferred embodiments of the invention as well as its advantages and essential details are disclosed in the drawings and in the following description and claims.

BRIEF DESCRIPTION OF THE DRAWING

The invention will now be described with reference to the drawing wherein.

DESCRIPTION OF THE PREFERRED EMBODIMENTS OF THE INVENTION

Figure 1:
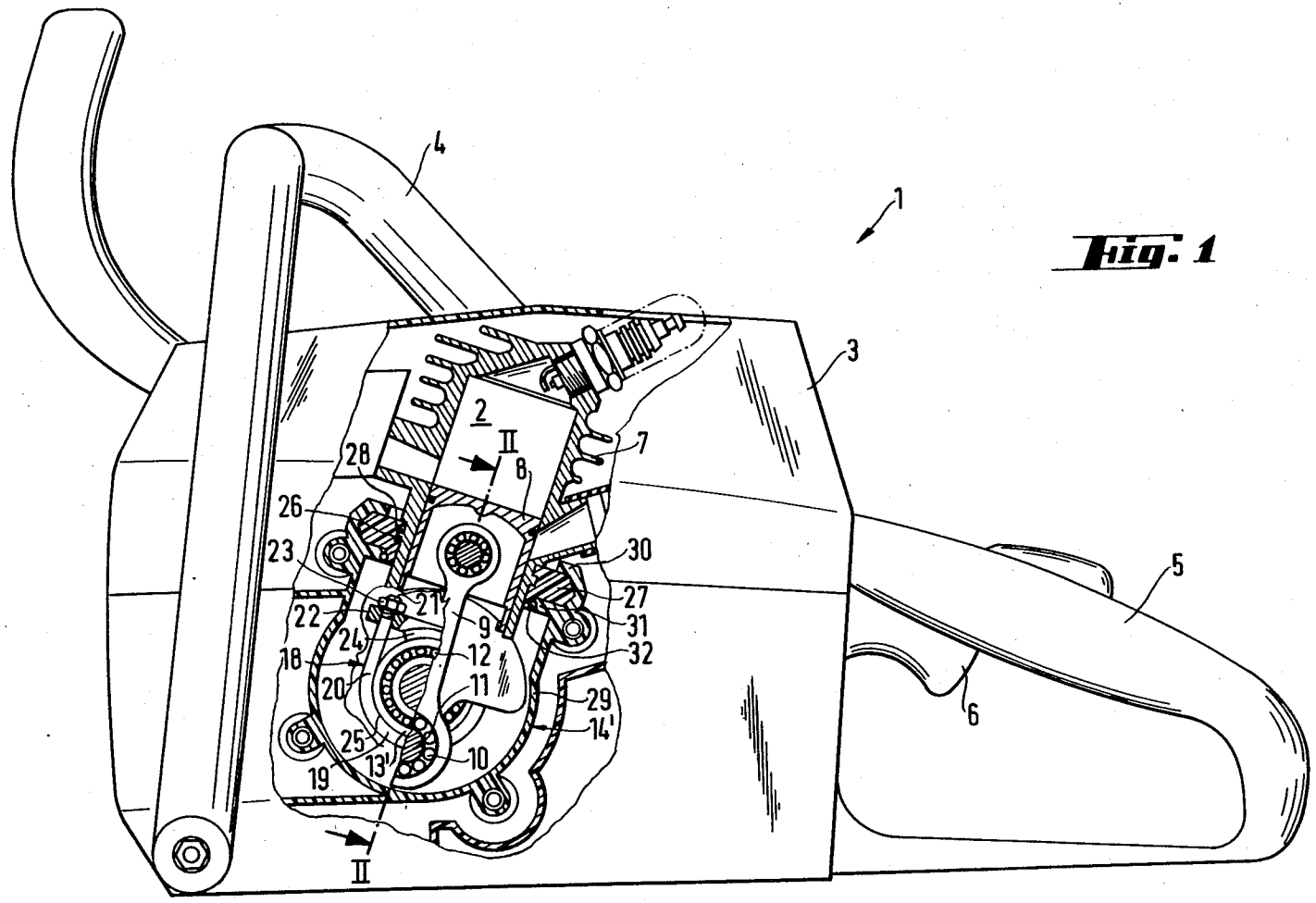
FIG. 1 is a side elevation view of the power head of a chain saw with a portion of the housing broken away to show the crankshaft assembly according to the invention.

The portable tool shown in FIG. 1 is preferably configured as a chain saw or a hedge trimmer and includes an internal combustion engine 2 mounted in a housing 3. The tool includes a bale handle 4 and a rearward handle 5 in which the gas lever 6 for the internal combustion engine 2 is mounted.

The engine 2 includes a cylinder 7 wherein a piston 8 is mounted for reciprocatory movement. The piston 8 is journalled on a connecting rod 9 which is connected to a crankshaft 11 by means of a connecting rod bearing 10.

The crankshaft 11 is rotatably journalled in two crankshaft bearings 12 which are mounted in respective bearing shells 13. The bearing shells 13 are releasably connected to the cylinder 7 of the engine 2 in such a manner that a mechanically rigid connection is provided so that the forces occurring in the region of the crankshaft during the operation of the engine are taken up directly with absolute certainty.

The crankshaft region is surrounded by a crankcase 14 which preferably is made of a low cost plastic and is of a thin-walled lightweight configuration. The plastic crankcase 14 is preferably made of two housing shells 15, 16 which tightly abut each other along a partition plane 17 of the plastic crankcase 14 which extends perpendicularly to the crankshaft 11.

The plastic crankcase 14 is mounted completely free and independently of the crankshaft bearing on the cylinder 7 so that the plastic crankcase 14 itself does not have to take up any special forces. The forces occurring during operation in the region of the crankcase are exclusively taken up by the crankshaft bearings 12 via the bearing shells 13 with the crankshaft bearings 12 being mounted in a mechanically rigid connection. As a consequence, the plastic crankcase 14 remains free of loading and is substantially free of any transmitted forces and simply serves to seal and isolate or surround the crankcase region. The plastic crankcase 14 mounted separately and independently of the crankshaft bearing on cylinder 7 is so configured that the upper region of the fastening rim of the housing 14 lies in a plane far above the center of the crankshaft and above the fastening region of the bearing shells 13.

Figure 2:
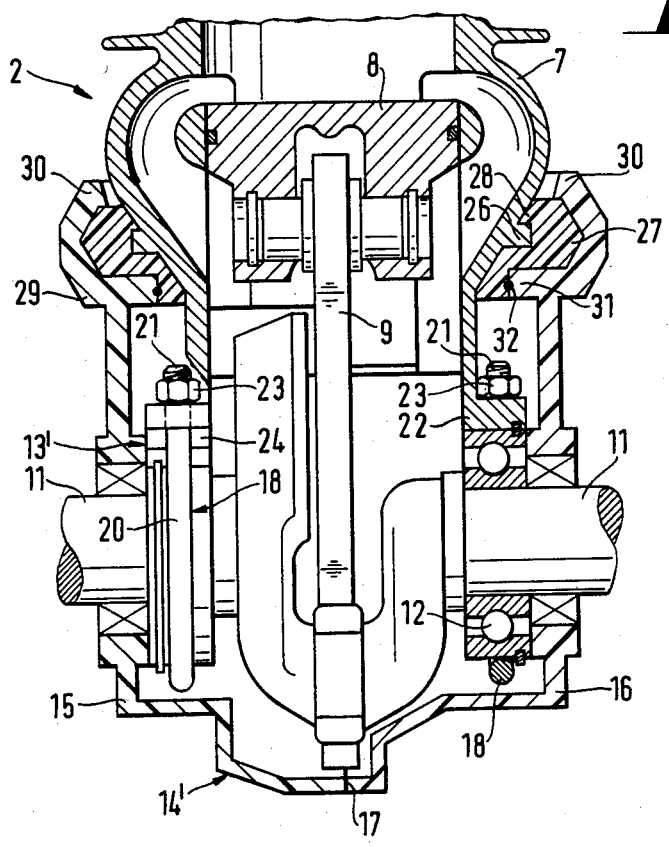
FIG. 2 is an elevation view, partially in section, taken through the crankshaft assembly of the tool of FIG. 1.

In the embodiment according to FIGS. 1 and 2, the two crankshaft bearings 12 are each rigidly mounted to cylinder 7 by means of corresponding ones of U-shaped bracket 18. The U-shaped bracket 18 is made from a round steel bar and includes a rounded bight portion 19 and two legs 20. The free ends of the legs 20 have threads 21 formed thereon and pass through a collar 22 formed on the lower end of the cylinder 7 on which the U-shaped brackets 18 are threadably fastened by means of nuts 23. The bearing shell 13' of this embodiment is configured in two parts and has an upper bearing part 24 mounted on the cylinder 7 and a lower bearing part 25 which is held in the bight 19 of the U-shaped bracket 18 and is surrounded by the latter. The bearing shell part 24 and the shell part 25 corresponding thereto tightly hold the crankshaft bearing 12 and are configured as semicircular arcs.

In the embodiment of FIGS. 1 and 2, projections 26 are formed outside on the cylinder 7 and hold the plastic insulating ring 27. A nose 28 of the insulating ring 27 overlaps the projection 26. This plastic insulating ring 27 can be made of a high-quality plastic and especially a plastic which is resistant to temperature and which resists the high temperatures occurring directly at cylinder 7. This plastic further substantially shields these temperatures because of the poor heat conductivity of the insulating ring 27 and therefore does not conduct the heat to the wall 29 of the plastic crankcase 14' so that the latter can be manufactured from an inexpensive plastic material which must not satisfy any high temperature requirements.

The two housing shells 15, 16 have respective collars 30 directed inwardly for fastening the plastic crankcase 14'. These collars 30 overlap the plastic insulating ring 27. An inwardly directed supporting rib 31 is formed on the wall 29 of the plastic crankcase 14' and overlaps and grips the plastic insulating ring 27 from above and below. A sealing ring 32 is held in an annular groove between the supporting rib 31 and the insulating ring 27.

In the embodiments of FIGS. 3 to 6, the crankshaft bearings 12 are arranged in such bearing shells which are preferably made as one piece and of the same material throughout so that they can be made very inexpensively by a stamping and bending process and are configured as sheet metal bearing shields 13''. The sheet metal bearing shield 13'' has a base wall 33 from which two parallel holding struts 34 extend. The free end regions of the holding struts 34 are configured as holding rails 35 configured so as to be approximately U-shaped when viewed in cross-section. The holding rails 35 are pushed onto the projections 26 of the cylinder 7 and are tightly held in this position so that a mechanically rigid connection between the cylinder 7 and the crankshaft bearings is obtained.

Figure 3:
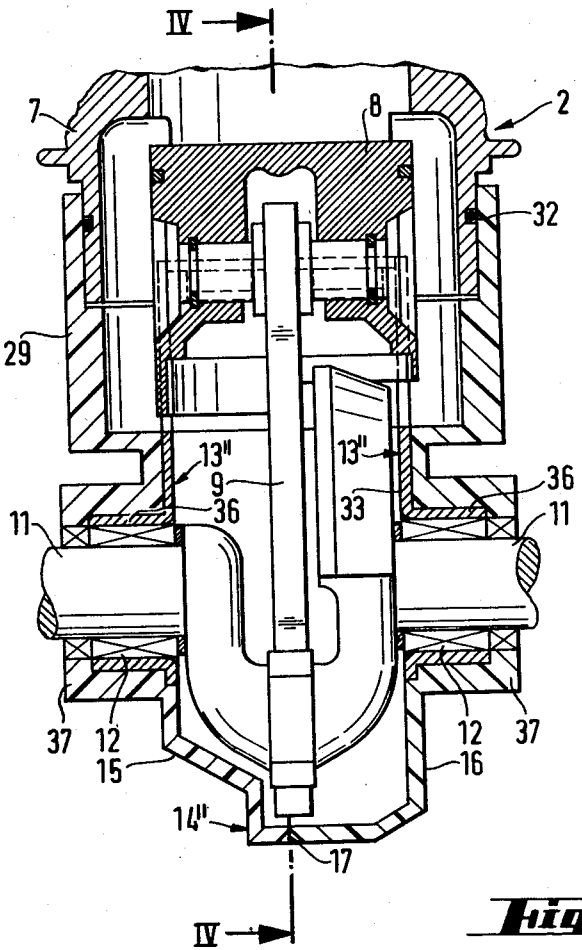
FIG. 3 is an elevation view, partially in section, showing a crankshaft assembly according to another embodiment of the invention.
Figure 5:
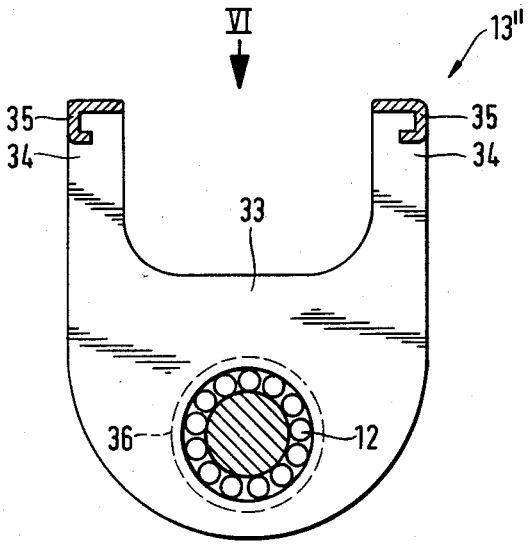
FIG. 5 is a side elevation view of a metal bearing shield shown in the crankshaft assembly of FIGS. 3 and 4.
Figure 6:
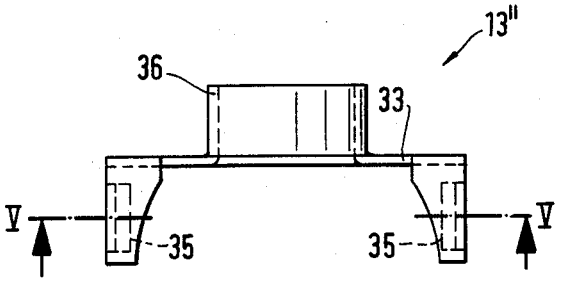
FIG. 6 is a plan view of the bearing shield of FIG. 5 viewed in the direction of arrow VI in FIG. 5; and, FIG. 7 is a side elevation view of the lower region of the cylinder of the tool of FIG. 1 equipped with a stationary journal for the crankshaft bearing with the stationary journal flange connected directly to the lower end face of the cylinder.

The sheet metal shield 13'' includes a sheet metal ring 36 wherein the crankcase bearing 12 is tightly enclosed. The sheet metal ring 36 is advantageously pulled through and formed on the base wall 33 so that no loose parts are present. FIG. 3 shows that the sheet metal rings 36 of the sheet metal bearing shields 13'', respectively, are located in the region of the tubular parts 37 which are formed on the housing shells 15, 16 of the plastic crankcase 14'' and from which the crankshaft 11 projects.

Figure 4:
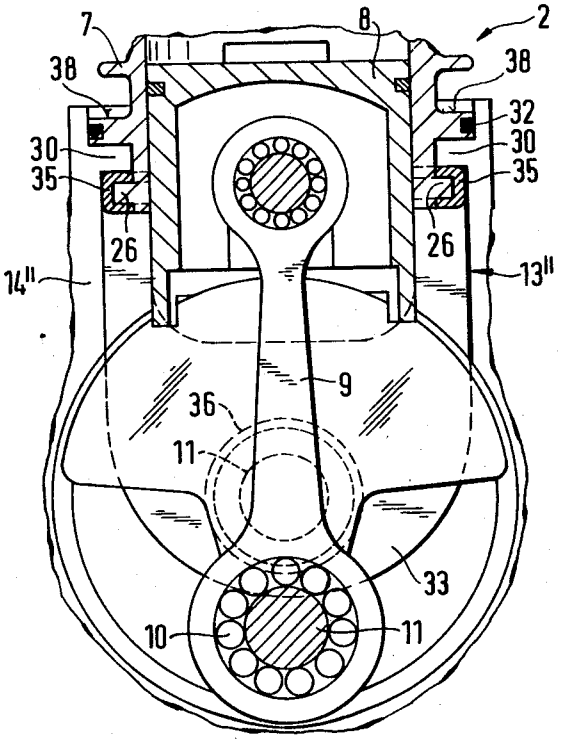
FIG. 4 is an elevation view, partially in section, of the assembly of FIG. 3 taken along line IV—IV FIG. 3.

FIG. 4 shows how the holding rails 35 of the bearing shields 13'' overlap the projections 26 of the cylinder 7. The collar 30 of the plastic crankcase 14'' directly overlaps the holding rails 35 from above and a projection 38 of the cylinder 7 from below. The sealing ring 32 is mounted in the projection 38 and seals the plastic crankcase 14''.

Figure 7:
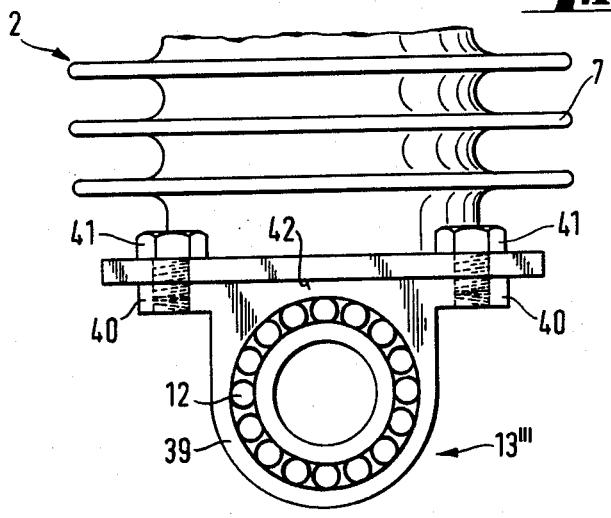

The embodiment of FIG. 7 shows that the crankshaft bearing 12 is mounted in a bearing block 13''' which is configured as a bearing shell. The bearing block 13''' is made as a one piece stationary bearing block having a form of approximately an inverted omega. The stationary bearing block includes a base body 39 having outwardly extending holding legs 40 on both sides and in which the crankshaft bearing 12 is mounted. The holding legs 40 are each tightly flange-connected to the lower surface 42 of the cylinder 7 by means of a threaded fastener 41 so that a mechanically rigid connection between the crankshaft bearing and the cylinder 7 is formed such that the plastic crankcase (not shown) is not subjected to any special forces of the crankdrive and can be made easily and very lightweight.

The plastic insulating ring 27 utilized in the embodiment according to FIGS. 1 and 2 is not absolutely necessary for securing the plastic crankcase 14'. It is possible to attach the plastic crankcase directly to the cylinder 7 or in a manner similar to that shown for the embodiment of FIGS. 3 and 4. With extreme temperature loading, it can however be advantageous to place the plastic insulating ring 27 between the cylinder 7 and the wall 29 of the plastic crankcase 14' The plastic insulating ring 27 itself can be made of a plurality of parts to simplify manufacture and assembly. It is especially advantageous to configure the insulating ring 27 so that it is made of two parts. Further, it can be advantageous to form the insulating ring 27 directly on the cylinder 7 during manufacture or to spray the insulating ring onto the cylinder 7.

It is understood that the foregoing description is that of the preferred embodiments of the invention and that various changes and modifications may be made thereto without departing from the spirit and scope of the invention as defined in the appended claims.

What is claimed is:

1. A crankshaft assembly for an engine of a portable tool such as a chain saw or the like, the engine including a cylinder, a piston arranged for movement in the cylinder, a crankshaft and a connecting rod interconnecting the piston and the crankshaft, the crankshaft assembly comprising:

bearing means for rotatably journalling said crankshaft and for receiving the reaction forces transmitted to the latter during operation of the engine;

bearing shell means for holding said bearing means therein, said bearing shell means being rigidly connected directly to said cylinder to thereby take up said forces; and, a plastic crankcase enclosing said crankshaft and said bearing means, said crankcase being mounted on said cylinder separately from said bearing shell means so as to prevent transmitting said forces from said bearing shell means to said plastic crankcase.

2. The crankshaft assembly of claim 1, said crankshaft having a mid portion disposed beneath said cylinder, said bearing means including two bearings for rotatably journalling said mid portion therebetween; said bearing shell means including two bearing shells for holding respective ones of said bearings, and said assembly further comprising first fastening means for rigidly connecting said bearing shells directly to said cylinder in a first plane; and, second fastening means for connecting said crankcase to said cylinder in a second plane above said first fastening means and above said mid portion of said crankshaft.

3. The crankshaft assembly of claim 2, said first fastening means including two U-shaped brackets for attaching respective ones of said bearing shells and bearings to said cylinder.

4. The crankshaft assembly of claim 3, said cylinder having a flange-like collar formed thereon, the free legs of each of said U-shaped brackets having a thread formed thereon, said first fastening means further including a plurality of threaded members for engaging corresponding ones of said threaded free ends to fasten said bearing shells to said flange-like collar.

5. The crankshaft assembly of claim 4, each of said bearing shells being made up of two parts, one of said parts being formed on said cylinder and the other one of said parts being mounted in the bight portion of said U-shaped bracket between said free legs thereof.

6. The crankshaft assembly of claim 2, said plastic crankcase being made of two mutually abutting crankcase shells conjointly defining a partition interface disposed in a plane perpendicular to said crankshaft, said second fastening means comprising projection means formed on said cylinder; and, inwardly directed collar means formed on said crankcase shells for engaging said projection means to hold said crankcase on said cylinder.

7. The crankshaft assembly of claim 6, said second fastening means comprising a temperature-resistant plastic insulating ring disposed between said collar means and said cylinder.

8. The crankshaft assembly of claim 7, comprising a sealing ring disposed between the wall of said crankcase and said cylinder.

9. The crankshaft assembly of claim 7, said temperature-resistant insulating ring being mounted on said projection means of said cylinder, said collar means being configured to overlappingly engage said insulating ring.

10. The crankshaft assembly of claim 2, each of said bearing shells being a sheet metal bearing shield configured as an integral piece.

11. The crankshaft assembly of claim 10, said first fastening means comprising projection means formed on said cylinder; and, attachment rail means formed on each of said sheet metal bearing shields for attachingly engaging said projection means thereby attaching said bearing shields to said cylinder.

12. The crankshaft assembly of claim 10, each of said sheet metal bearing shields being drawn to have a sheet metal ring formed therein for holding a corresponding one of said bearings therein.

13. The crankshaft assembly of claim 12, said crankcase having a pair of tubular projections formed thereon for overlapping and surrounding corresponding ones of said sheet metal rings.

14. A crankshaft assembly for an engine of a portable tool such as a chain saw or the like, the engine including a cylinder, a piston arranged for movement in the cylinder, a crankshaft and a connecting rod interconnecting the piston and the crankshaft, said crankshaft having a mid portion disposed beneath said cylinder, the crankshaft assembly comprising:

two bearings for rotatably journalling said mid portion therebetween and for receiving the reaction forces transmitted to the latter during operation of the engine;

two inverted flanged bearing blocks for holding respective ones of said bearings;

first fastening means for rigidly connecting said bearing blocks directly to said cylinder to thereby take up said forces;

a plastic crankcase enclosing said mid portion and said bearings; and, second fastening means for attaching said crankcase to said cylinder separately from said bearing blocks so as to prevent transmitting said forces from said bearing blocks to said crankcase.

15. The crankshaft assembly of claim 14, said cylinder having a lower end face facing toward said mid portion of said crankshaft, each of said bearing blocks having an inverted omega-like shape with a base body for accommodating a corresponding one of said bearings therein and two flange-like arms extending from said base body, said first fastening means including fasteners for tightly fastening said bearing blocks to said end face of said cylinder.

16. A power head for a portable tool such as a chain saw, hedge trimmer or the like, the power head comprising:

a housing; and, an engine mounted in the housing and including:

a cylinder;

a crankshaft;

a connecting rod interconnecting the piston and the crankshaft, the crankshaft having a mid portion disposed beneath said cylinder;

two bearings for rotatably journalling said mid portion therebetween and for receiving the reaction forces transmitted to the latter during operation of the engine;

bearing shell means for holding said bearings therein, said bearing shell means being rigidly connected directly to said cylinder to thereby take up said forces; and, a plastic crankcase enclosing said crankshaft and said bearing means, said crankcase being mounted on said cylinder separately from said bearing shell means so as to prevent transmitting said forces from said bearing shell means to said plastic crankcase.

* * * * *